US005660752A

United States Patent [19]

Vilzmann

[11] Patent Number: 5,660,752

[45] Date of Patent: Aug. 26, 1997

[54] HEATING ELEMENT AND PROCESS FOR HEATING CRUCIBLES

[75] Inventor: Peter Vilzmann, Burghausen, Germany

[73] Assignee: Wacker Siltronic Gesellschaft Für Halbleitermaterialien Aktiengesellschaft, Burghausen, Germany

[21] Appl. No.: 450,481

[22] Filed: May 26, 1995

[30] Foreign Application Priority Data

Jul. 1, 1994 [DE] Germany ..... 44 23 196.2

[51] Int. Cl.[6] ..... H05B 3/10

[52] U.S. Cl. ..... 219/553; 219/541; 219/420; 373/118

[58] Field of Search ..... 219/420, 535, 219/426–427, 553, 541; 432/156, 262, 265; 373/117–119, 132, 134

[56] References Cited

U.S. PATENT DOCUMENTS

| | | | |
|---|---|---|---|
| 2,640,861 | 6/1953 | Kremers | 219/553 |
| 2,650,254 | 8/1953 | Kremers | 373/132 |
| 3,726,984 | 4/1973 | Anthony et al. | 373/128 |
| 4,347,431 | 8/1982 | Pearce et al. | 373/117 |
| 4,432,093 | 2/1984 | Reboux | 373/157 |
| 4,467,185 | 8/1984 | Moritoki et al. | 373/134 |
| 4,503,319 | 3/1985 | Moritoki et al. | 219/553 |
| 4,755,658 | 7/1988 | Wilsey | 219/553 |

FOREIGN PATENT DOCUMENTS

| | | | |
|---|---|---|---|
| 0080013 | 6/1983 | European Pat. Off. . | |
| 2064961 | 9/1971 | Germany . | |
| 137894 | 7/1985 | Japan | 219/553 |
| 169089 | 6/1992 | Japan | 219/553 |

*Primary Examiner*—Teresa J. Walberg
*Assistant Examiner*—Raphael Valencia
*Attorney, Agent, or Firm*—Collard & Roe, P.C.

[57] ABSTRACT

A heating element for heating crucibles, including a cylindrical hollow body which is divided by slits into meandrous segments. The corners between adjacent lateral surfaces of the meanders are rounded. Sectional transition areas are located in the vicinity of the upper and lower edges of the meandrous segments. Each sectional area has an outer rounded edge with a radius of curvature equal to the individual length of each meandrous section.

5 Claims, 2 Drawing Sheets

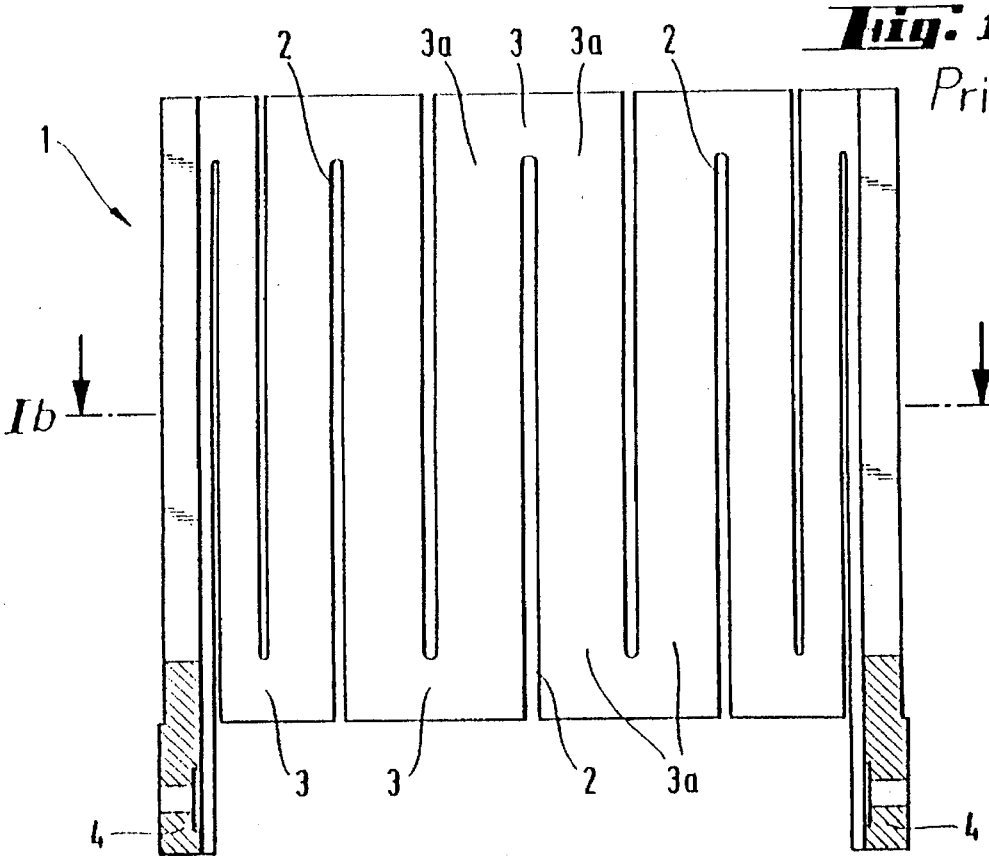
Fig. 1a – Prior Art
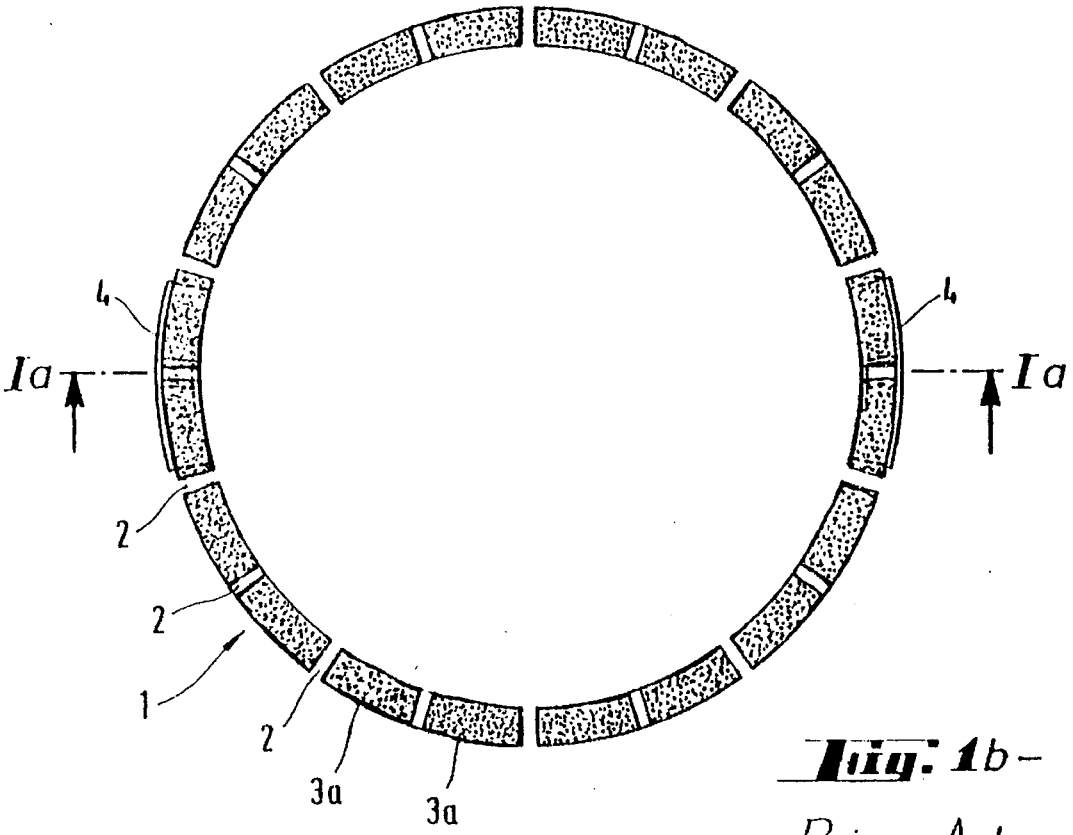
Fig. 1b – Prior Art

HEATING ELEMENT AND PROCESS FOR HEATING CRUCIBLES

BACKGROUND OF THE INVENTION

1. Field of the Invention

The present invention relates to a device for heating crucibles.

2. The Prior Art

Heating elements are known for heating various containers, for example, crucibles. FIG. 1*a* is a longitudinal sectional view and FIG. 1*b* is a cross-sectional view through a generic prior art heating element for crucibles. The heating element has the shape of a cylindrical hollow body 1 which as a rule is made of graphite. The heating element is used in the preparation of crucible-pulled, single crystals composed of semiconductor material. The cylindrical hollow body is incised at intervals by slits 2, which start alternately from the upper or lower rim of the hollow body and extend almost to the respective opposite rim. The slits divide the hollow body into individual interlinked segments, which are referred to as meanders 3. Each meander is partially separated by a slit into a left and a right meander half 3*a*. At least two supply leads 4 are connected to the lower rim of the heating element. An electric power source is connected to the supply leads.

The diameter of the heating element may decrease towards the lower rim of the hollow body, so that the heating element is configured to match the shape of the crucible to be heated. For the sake of clarity and simplicity, the figures show embodiments having a constant diameter. However, the inventive concept is equally applicable to heating elements of any shape.

Normally, the upper rim of the heating element extends above the upper rim of the crucible to ensure that the crucible contents are uniformly heated by the thermal radiation emitted by the heating element. During the process of growing single crystals composed of semiconductor material, especially of silicon, molten semi-conductor material from the crucible often reaches the surface of the heating element. The rim of the heating element which extends above the crucible rim is particularly affected by this, since under certain doping conditions, it is possible for molten material to splash from the crucible. Moreover, semiconductor material which leaves the crucible in the gaseous state recondenses on the rim of the heating element. These deposits may, as in the case of silicon, react with the graphite of the heating element to produce carbidic phases which cause stresses in the heating element because of differential thermal expansion coefficients. These stresses are frequently resolved when portions spall off from the heating element and drop into the crucible while crystals are growing. There they significantly interfere with the dislocation-free growth of the single crystal. In particularly unfavorable cases, it is even necessary to terminate crystal growing because of such an incident. Repeating spalling of portions of the heating element greatly reduces its service life, requiring replacement at an earlier time. The disruption-free growing of crystals and the service life of the heating element are further effected by electrical flash-overs, which become more frequent as semiconductor material additionally condenses, in particular, in the vicinity of the lower rim of the heating element. This reduces the slit width between the meanders and/or the gap between the heating element and adjacent parts of the system.

SUMMARY OF THE INVENTION

It is therefore an object of the present invention to provide a heating element which overcomes the drawbacks of the prior art and which is less subject to wear and which is more suitable for growing single crystals.

These and other related objects are achieved according to the invention by a device for heating crucibles including a heating element comprising a hollow cylindrical body including slits for dividing the cylindrical body into meandrous segments having lateral surfaces and rounded corners between the adjacent lateral surfaces. Each meandrous segment has a cross sectional length L, an upper edge and a lower edge. The cylindrical body further includes sectional transition areas in the vicinity of the upper and lower edges extending between adjacent meandrous segments. Sectional transition areas each have an outer rounded edge with a radius of curvature R, which is approximately equal to length L.

The sectional transition areas have a perimeter extending around the sectional transition area. The perimeter consists exclusively of straight portions and curved portions. The meandrous segments are made of graphite. The invention also contemplates a method for using the device including the steps of heating a crucible with the heating element to grow single crystals of silicon semiconductor material.

BRIEF DESCRIPTION OF THE DRAWINGS

Other objects and features of the present invention will become apparent from the following detailed description considered in connection with the accompanying drawings which disclose a single embodiment of the present invention. It should be understood, however, that the drawings are designed for the purpose of illustration only and not as a definition of the limits of the invention.

In the drawings, wherein similar reference characters denote similar elements throughout the several views:

FIG. 1*a* is a longitudinal sectional view of a prior art heating element;

FIG. 1*b* is a cross-sectional view taken along the line Ib—Ib from FIG. 1*a;*

DETAILED DESCRIPTION OF PREFERRED EMBODIMENTS

Figure 2A:
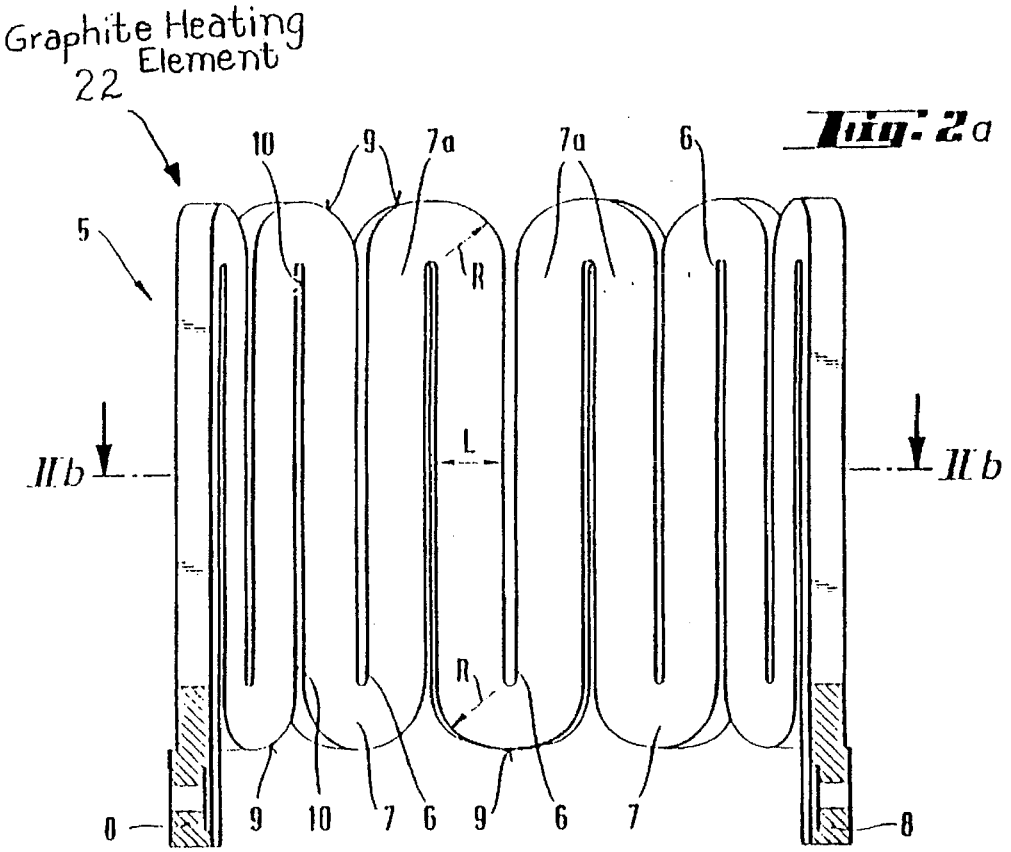
FIG. 2*a* is a longitudinal sectional view of a heating element according to the invention.

Turning now in detail to the drawings and in particular FIG. 2*a*, there is shown a heating element 22 according to the invention including a cylindrical hollow body 5 incised by vertical slits 6. Slits 6 alternately start from the upper and lower rim and run towards the respective opposite rim, thus producing the typical shape of juxtaposed meanders 7. In the lower rim zone of the hollow body, at least two supply leads 8 are connected to the meanders. During operation of the heating element, supply leads 8 are connected to an electric power source.

Figure 2B:
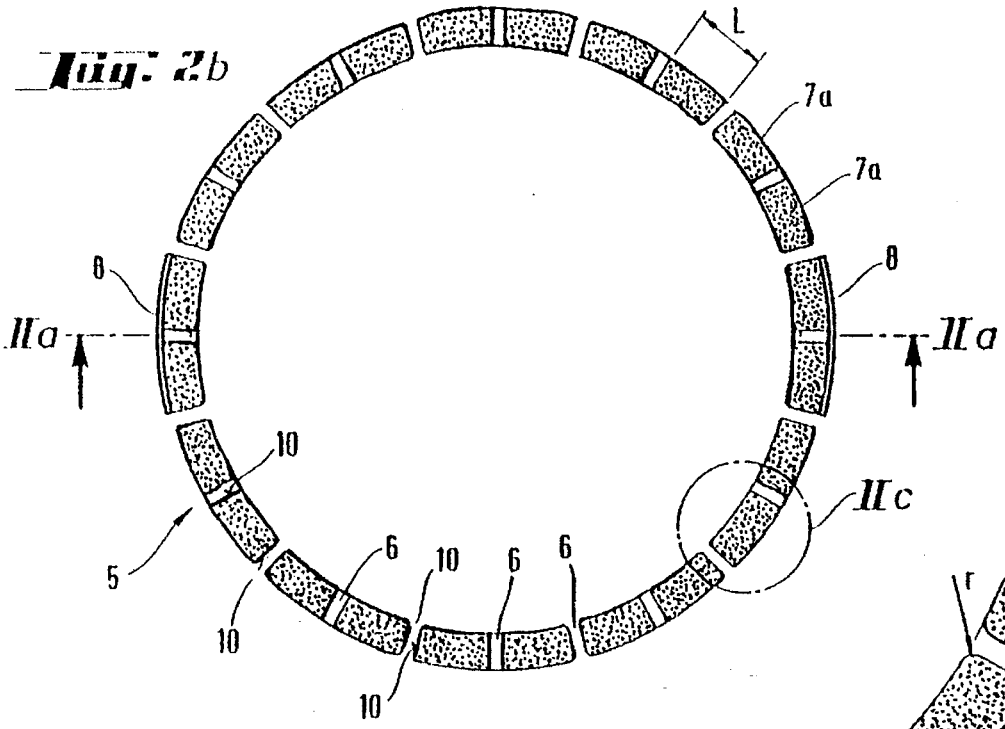
FIG. 2*b* is a cross-sectional view taken along the line IIb—IIb from FIG. 2*a*.
Figure 2C:
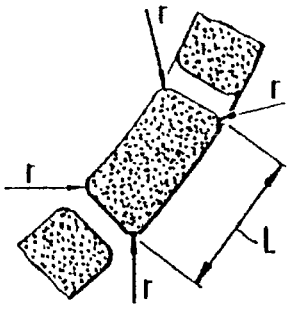
FIG. 2*c* is an enlarged view of a section of the heating element.

As can be seen in FIG. 2*c*, the corners between two adjacent lateral faces of each meander are rounded with a radius r so that the meanders are free of edges and vertices.

FIG. 2*a* shows an outer rounded edge 9 of the sectional transitional areas in the vicinity of the upper and lower rim, respectively. Edges 9 of the sectional areas are rounded arcuately which gives the rim contours a rosette-like appearance. The radius of curvature R of the edges is preferably equal to or approximately equal to the cross-sectional length L of the meander half *7a*.

FIG. 2*b* shows perimeters 10 of the sectional areas having exclusively straight or curved portions.

To produce the heating element according to the invention, a shaped article of suitable size, for example, a graphite block or a graphite cylinder is subjected to a mechanical shaping process, for example, by piercing, cutting, grinding, milling or the like. First a cylindrical hollow body is produced from a solid shaped article. The hollow body is then provided with the appropriate slits and thus divided into meandrous segments. Finally, the angular transitions between adjoining lateral faces of the meanders are rounded, and enough material is removed in the vicinity of the upper and lower rim, respectively, of the hollow body for the longitudinal sectional areas through the meanders to attain the rounded shape envisaged. An edge is regarded as rounded, in the context of the invention, even in those cases where the mechanical machining is effected by a computer-controlled machining tool which produces curved surfaces which at a sufficiently high resolution can be discerned as stepped level changes.

Provided with the necessary supply leads, the heating element according to the invention is employed to particular advantage as an electrical resistance heating source for heating crucibles in the preparation of single crystals from semiconductor material, preferably silicon. Heating elements having the features according to the invention are distinguished by generating a heating zone having a particularly uniform temperature profile. Employing the inventive heating element in pulling single crystals composed of semiconductor material, results in less frequent crystal growth faults which can be ascribed, directly or indirectly, to malfunctions of the heating elements. Employing the inventive heating element increases the yield, which is based on the achievable length of dislocation-free single crystals. Moreover, the mean operating time after which a heating element, on average, has to be replaced, is more than twice as long, according to initial tests, as for conventional heating elements.

While only a single embodiment of the present invention has been shown and described, it is to be understood that many changes and modifications may be made thereunto without departing from the spirit and scope of the invention as defined in the appended claims.

What is claimed is:

1. A heating element for heating crucibles comprising:

a hollow cylindrical body having an upper and a lower rim and including slits for dividing said hollow cylindrical body into meandrous segments, said meandrous segments including longitudinal sectional members with arcuately rounded transitional areas at said rims; and said meandrous segments having cross-sectional areas surrounded by a perimeter consisting exclusively of straight portions and curved portions, edges being absent between said straight portions and said curved portions.

2. The heating element according to claim 1, wherein said arcuately rounded transitional areas have a radius of curvature R which is approximately equal to a cross-sectional length L of one-half of a meandrous segment.

3. The heating element according to claim 1, wherein said meandrous segments are made of graphite.

4. The heating element according to claim 1, wherein said longitudinal sectional members are alternately connected together at said upper and lower rims by said arcuately rounded transitional areas;

wherein the perimeter of the cross-sectional areas consists exclusively of alternating straight portions and curved portions so that the cross-sectional areas are devoid of vertices; and wherein the cross-sectional area is approximately constant throughout substantially all of said meandrous segments, the constant cross-sectional area and said curved portions result in a homogeneously-distributed flux of electric current through said meandrous segments whereby temperature differentials at the perimeter are minimized so that accumulated foreign particles on said perimeter are less likely to spall off.

5. A process for heating a crucible for growing a single crystal of silicon, comprising the steps of:

providing a heating element comprising a hollow cylindrical body having an upper and a lower rim and including slits for dividing said hollow cylindrical body into meandrous segments, said meandrous segments include longitudinal sectional members with arcuately rounded transitional areas at said rims, said meandrous segments have cross-sectional areas surrounded by a perimeter consisting exclusively of straight portions and curved portions; edges being absent between said straight portions and said curved portions; and heating a crucible with said heating element to grow a single crystal of silicon.

* * * * *